US008968029B2

(12) United States Patent
Yun

(10) Patent No.: US 8,968,029 B2
(45) Date of Patent: Mar. 3, 2015

(54) SOCKET FOR NANO SIM CARD

(71) Applicant: JuYoung Yun, Osan (KR)

(72) Inventor: JuYoung Yun, Osan (KR)

(73) Assignee: Uju Electronics Co. Ltd., Hwaseong-Si (KR)

( * ) Notice: Subject to any disclaimer, the term of this patent is extended or adjusted under 35 U.S.C. 154(b) by 92 days.

(21) Appl. No.: 13/846,501

(22) Filed: Mar. 18, 2013

(65) Prior Publication Data

US 2014/0273646 A1 Sep. 18, 2014

(51) Int. Cl.
*H01R 24/00* (2011.01)
*H01R 12/71* (2011.01)

(52) U.S. Cl.
CPC ..... *H01R 12/714* (2013.01)
USPC ..... 439/630; 439/159

(58) Field of Classification Search
USPC ..... 439/159, 160, 630–633
See application file for complete search history.

(56) References Cited

U.S. PATENT DOCUMENTS

| | | | | |
|---|---|---|---|---|
| 6,764,327 | B2 * | 7/2004 | Yu | 439/188 |
| 7,708,598 | B2 * | 5/2010 | Hu | 439/630 |
| 8,337,223 | B2 * | 12/2012 | Gao et al. | 439/159 |
| 8,371,865 | B1 * | 2/2013 | Su | 439/155 |
| 8,371,866 | B1 * | 2/2013 | Su et al. | 439/159 |
| 8,439,696 | B2 * | 5/2013 | Zhou et al. | 439/188 |
| 8,734,188 | B2 * | 5/2014 | Nakase et al. | 439/630 |
| 8,747,131 | B2 * | 6/2014 | Nakase et al. | 439/159 |
| 8,777,669 | B2 * | 7/2014 | Hu et al. | 439/630 |
| 2003/0109178 | A1 * | 6/2003 | Ohashi | 439/630 |
| 2003/0211783 | A1 * | 11/2003 | Matsunaga et al. | 439/630 |
| 2007/0117463 | A1 * | 5/2007 | Washino et al. | 439/630 |
| 2007/0128942 | A1 * | 6/2007 | Li | 439/630 |
| 2007/0161274 | A1 * | 7/2007 | Tanaka et al. | 439/159 |
| 2008/0102680 | A1 * | 5/2008 | Chang et al. | 439/326 |
| 2009/0137136 | A1 * | 5/2009 | Shen | 439/83 |
| 2009/0186499 | A1 * | 7/2009 | Ma et al. | 439/79 |
| 2010/0062620 | A1 * | 3/2010 | Lei et al. | 439/66 |
| 2011/0151700 | A1 * | 6/2011 | Shen et al. | 439/326 |
| 2011/0269328 | A1 * | 11/2011 | Huo | 439/345 |
| 2011/0294310 | A1 * | 12/2011 | Li | 439/74 |
| 2011/0294322 | A1 * | 12/2011 | Kikuchi et al. | 439/152 |
| 2012/0083145 | A1 * | 4/2012 | Gao et al. | 439/155 |
| 2012/0094514 | A1 * | 4/2012 | Sun et al. | 439/159 |

(Continued)

OTHER PUBLICATIONS

"Everything you want to know about nano-Sim being used in iPhone 5" NDTV correspondent, Sep. 13, 2012, http://gadgets.ndtv.com/mobiles/news/everything-you-want-to-know-about-nano-sim-being-used-in-iphone-5-266771.*

*Primary Examiner* — Ross Gushi
(74) *Attorney, Agent, or Firm* — John K. Park; Park Law Firm

(57) ABSTRACT

The present invention relate to a socket for a nano SIM card first to third connection parts arranged in a transverse direction, and fourth to sixth connection parts arranged in parallel with the first to third connection parts. The socket comprises: first to sixth terminals each comprising a contact part configured to be brought into close contact with an associated one of the connection parts of the nano SIM card and a soldering part configured to be soldered to a print circuit board; a housing comprising through-openings for first to sixth contact parts, which are formed at positions corresponding to the positions of the respective connection parts of the nano SIM card when the nano SIM card is inserted into the socket; and a cover coupled to the housing to define a space between the housing and the cover so that the SIM card is inserted into the space.

4 Claims, 6 Drawing Sheets

(56) References Cited

U.S. PATENT DOCUMENTS

| | | | | |
|---|---|---|---|---|
| 2012/0129370 | A1* | 5/2012 | Zhou et al. | 439/188 |
| 2012/0276764 | A1* | 11/2012 | Nakase et al. | 439/159 |
| 2012/0276765 | A1* | 11/2012 | Nakase et al. | 439/159 |
| 2012/0276780 | A1* | 11/2012 | Hu et al. | 439/630 |
| 2012/0295481 | A1* | 11/2012 | Zhang | 439/607.22 |
| 2013/0040478 | A1* | 2/2013 | Hsu et al. | 439/159 |
| 2013/0059478 | A1* | 3/2013 | Liu et al. | 439/631 |
| 2013/0102170 | A1* | 4/2013 | Yang et al. | 439/153 |
| 2013/0130527 | A1* | 5/2013 | Lee et al. | 439/159 |
| 2013/0196523 | A1* | 8/2013 | Lim et al. | 439/153 |
| 2013/0210280 | A1* | 8/2013 | Soo | 439/626 |
| 2013/0225003 | A1* | 8/2013 | Liu | 439/629 |
| 2013/0231001 | A1* | 9/2013 | Joo | 439/345 |
| 2013/0237097 | A1* | 9/2013 | Nakamura | 439/633 |
| 2013/0288496 | A1* | 10/2013 | Ma | 439/159 |
| 2013/0288535 | A1* | 10/2013 | You et al. | 439/634 |
| 2013/0309885 | A1* | 11/2013 | Liu et al. | 439/153 |
| 2014/0045389 | A1* | 2/2014 | Yoshikawa et al. | 439/786 |
| 2014/0057469 | A1* | 2/2014 | Tsuji et al. | 439/159 |
| 2014/0099805 | A1* | 4/2014 | Kutchery et al. | 439/76.1 |
| 2014/0099809 | A1* | 4/2014 | Hsu | 439/159 |
| 2014/0120754 | A1* | 5/2014 | Lin et al. | 439/160 |
| 2014/0148036 | A1* | 5/2014 | Tan et al. | 439/345 |
| 2014/0199875 | A1* | 7/2014 | Choi et al. | 439/346 |
| 2014/0206215 | A1* | 7/2014 | Wang et al. | 439/160 |

* cited by examiner

– Prior Art –

SOCKET FOR NANO SIM CARD

TECHNICAL FIELD

The present invention relate to a socket for a nano SIM card, and more particularly, to such a socket for a nano SIM card, which is used to mount a nano SIM card that has been standardized recently and has length, width and thickness that are relatively reduced as compared to a, micro SIM card.

BACKGROUND ART

At present, cellular phones require much more various parts to pursue multifunctionality while following a trend toward compactness and lightweightness. Thus, a SIM card for identification of a subscriber also continues to follow a trend toward compactness.

Conventionally, an original SIM card (see FIG. 1(*a*)) used to identify subscribers of cellular phones is of the order of 25 mm and 15 mm in length and width, respectively, and a micro SIM card (see FIG. 1(*b*)) that has been used so far since the original SIM card was released is of the order of 15 mm and 12 mm in length and width, respectively. Currently, a nano SIM card (see FIG. 1(*c*)) 12 mm and 8 mm in length and width that are smaller than those of the micro SIM card began to be applied to real products.

The SIM card employs six connection parts 11 to 16 in a GSM scheme, but further employs two connection parts 17 and 18 for use in a transportation card in Korea. Resultantly, a total of eight connection parts are often used in the SIM card.

Typically, a socket configured to be installed in cellular phones so as to mount the SIM car has a structure that is disclosed in Korean Patent Registration No. 1201667 as shown in FIG. 2.

The socket includes: a housing 100 made of a synthetic resin material, a plurality of terminals 200 each having a contact part 210 mounted on the housing 100 and brought into close contact with an associated one of connection parts of an SIM card 10 and a soldering part 220 configured to be soldered to a printed circuit board; a cam slider 300 including a slider 310 having a heart cam 311, a spring 320, and an operating rod 330, and configured to insert and withdraw the SIM card 10 into and from the socket; and a cover 400 made of a metal material and coupled to the top of the housing 100 to define a space between the housing 100 and the cover 400 so that the SIM card is inserted into the space.

The terminals of such a conventional socket are configured such that the soldering parts are arranged in a row at a rear side of the socket and the contact parts have support points at a front side of the socket. The contact parts are formed in a cantilever shape which is extended toward the rear side of the socket. The contact parts of the terminals are exposed to the outside through through-openings for use in installation of the terminals on the housing so that they are brought into close contact with the connection parts of the SIM card by the elasticity of the cantilevers.

In case of the conventional SIM card shown in FIGS. 1(*a*) and 1(*b*), the connection parts are arranged in two rows. However, in case of the terminals of the socket connected to the connection parts of the SIM card, the soldering parts are arranged in one row, and thus there occur many cases where it is difficult to grasp the arrangement structure of the soldering parts of the terminals upon the design or after the assembly of the socket. In particular, the soldering parts are arranged in one row, and thus the soldering parts are densely spaced. In addition, since the soldering parts are protruded to the outside of the housing, various electrical failures occurs due to foreign substances introduced between the soldering parts of the respective terminals during the soldering of the soldering parts Particularly, in case of the smallest nano SIM card among the existing SIM cards, the spacings between the connection parts are the same as those of the conventional SIM card, but the entire size of the nano SIM is small and thus the size of the socket is small, making it difficult to sufficiently secure the spacings between the soldering parts. As a result, it is difficult to identify the arrangement structure of the soldering parts, which further greatly influences the introduction of foreign substances between the soldering parts.

In addition, in a structure of the socket shown in FIG. 2, a part of the SIM card is required to be protruded to the outside of the socket in order to fixedly insert and withdraw the SIM card into and from the socket in a push-push pattern by the operation of a heart cam. Also, the lengths of the cantilevers constituting the contact parts of the respective terminals are required to be equal to each other so that a contact force applied to the terminals are substantially constant. However, the nano SIM card as shown in FIG. 1(*c*) entails a problem in that the spacing L between the connection parts and the outer peripheral edge of the nano SIM card is small, making it difficult to sufficiently secure the length of the cantilevers constituting the contact parts of the respective terminals of the socket. In addition, the nano SIM card encounters another problem in that when the length of the cantilevers is made large, the size of the socket is increased, and thus the nano SIM card is concealingly inserted inside the socket, making it difficult to externally perform the push-push operation.

PRIOR ART LITERATURE

Patent Documents

KR 10-1201667 B, 2012.11.15., FIG. 6

DISCLOSURE OF INVENTION

Technical Problem

Accordingly, the present invention has been made in order to solve the above-mentioned problems occurring in the prior art, and it is a main object of the present invention to provide a socket for a nano SIM card, which allows the arrangement structure of the soldering parts of the terminals to be easily identified even in a small-sized socket, and prevents the electrical connection failure from occurring due to introduction of foreign substances between the soldering parts.

Another object of the present invention is to provide a socket for a nano SIM card, which allows, the nano SIM card having a structure in which the spacing between the connection parts and the outer peripheral edge of the nano SIM card is small, to be smoothly inserted and withdrawn into and from the socket, and which allows the contact parts of the terminals to be brought into close contact with the connection parts of the nano SIM card with a proper strength.

Technical Solution

To achieve the above objects, the present invention provides a socket for a nano SIM card including first to third connection parts arranged in a transverse direction, and fourth to sixth connection parts arranged in parallel with the first to third connection parts in such a manner that the first connection part confronts the fourth connection part, the second connection part confronts the fifth connection part, the third connection part confronts the sixth connection part, the socket including:

first to sixth terminals each including a contact part configured to be brought into close contact with an associated one of the connection parts of the nano SIM card and a soldering part configured to be soldered to a print circuit board;

a housing including through-openings for first to sixth contact parts, which are formed at positions corresponding to the positions of the respective connection parts of the nano SIM card when the nano SIM card is inserted into the socket; and a cover coupled to the housing to define a space between the housing and the cover so that the SIM card is inserted into the space, wherein the housing includes a through-opening for soldering parts, which is disposed between the through-openings for first to third contact parts, which are arranged in parallel with each other, and the through-openings for fourth to sixth contact parts, which are arranged in parallel with each other, wherein the contact parts of the first to sixth terminals are exposed to the outside through the through-openings for first to sixth contact parts, and wherein the soldering parts of the first to sixth terminals are exposed to the outside along the opposed inner peripheral surfaces of the through-opening for soldering parts, which runs in parallel with the transverse direction of the through-openings for first to sixth contact parts.

Preferably, the nano SIM card may further include a seventh connection part disposed between the first connection part and the fourth connection part, and an eighth connection part disposed between the third connection part and the sixth connection part.

Preferably, the socket may further include seventh and eighth terminals configured to be brought into close contact with the seventh and eighth connection parts of the nano SIM card.

Preferably, the housing may further include through-openings for seventh and eighth contact parts so as to allow the contact parts of the seventh and eighth terminals to be exposed to the outside therethrough.

Preferably, the soldering parts of the seventh and eighth terminals may be exposed to the outside along the opposed inner peripheral surfaces of the through-opening for soldering parts, which run in parallel with the longitudinal direction of the through-openings for seventh and eighth contact parts. Preferably, the contact part having a cantilever shape of at least one of the first to sixth terminals may be arranged obliquely relative to a direction in which the nano SIM card is inserted into the socket.

Preferably, the cover may further include a through-opening for observation so as to allow the through-opening for soldering parts to be observed therethrough.

Advantageous Effects

The present invention has the following advantageous effects.

The arrangement structure of the soldering parts of the terminals can be easily identified even in a small-sized socket, and the electrical connection failure can be prevented from occurring due to introduction of foreign substances between the soldering parts.

In addition, the nano SIM card having a structure in which the spacing between the connection parts and the outer peripheral edge of the nano SIM card is small, can be smoothly inserted and withdrawn into and from the socket, and the contact parts of the terminals can be brought into close contact with the connection parts of the nano SIM card with a proper strength.

BRIEF DESCRIPTION OF THE DRAWINGS

The above and other objects, features and advantages of the present invention will be apparent from the following detailed description of the preferred embodiments of the invention in conjunction with the accompanying drawings, in which.

EXPLANATION ON SYMBOLS

Figure 1:
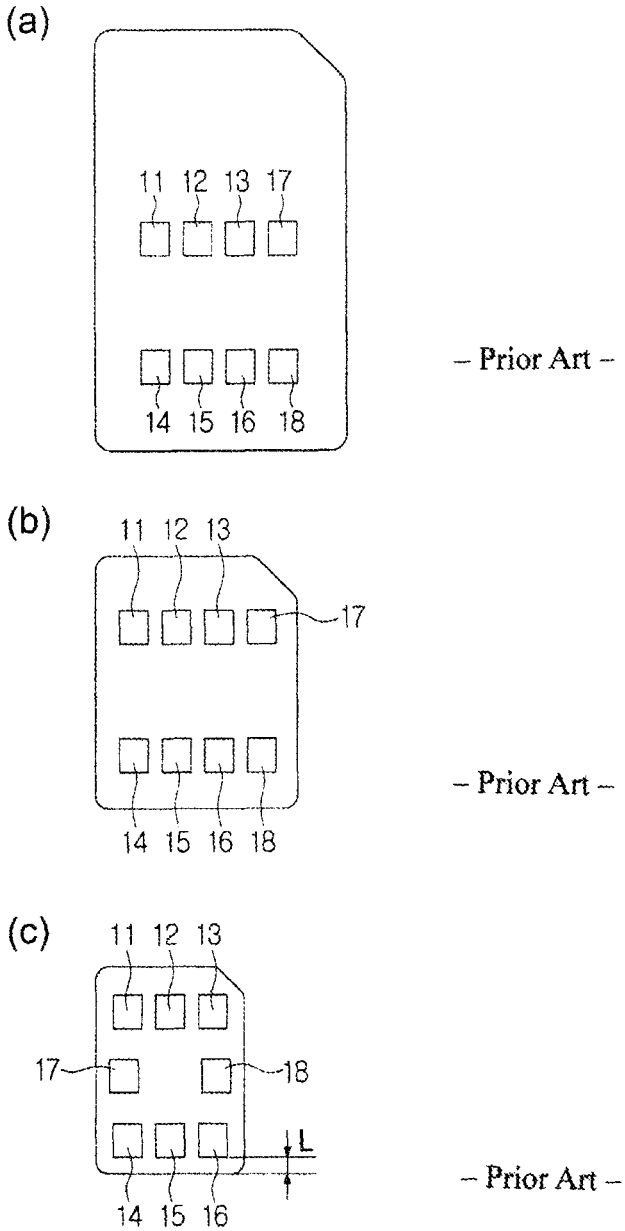
FIG. 1 is a schematic diagrammatic view illustrating various kinds of SIM cards.
Figure 2:
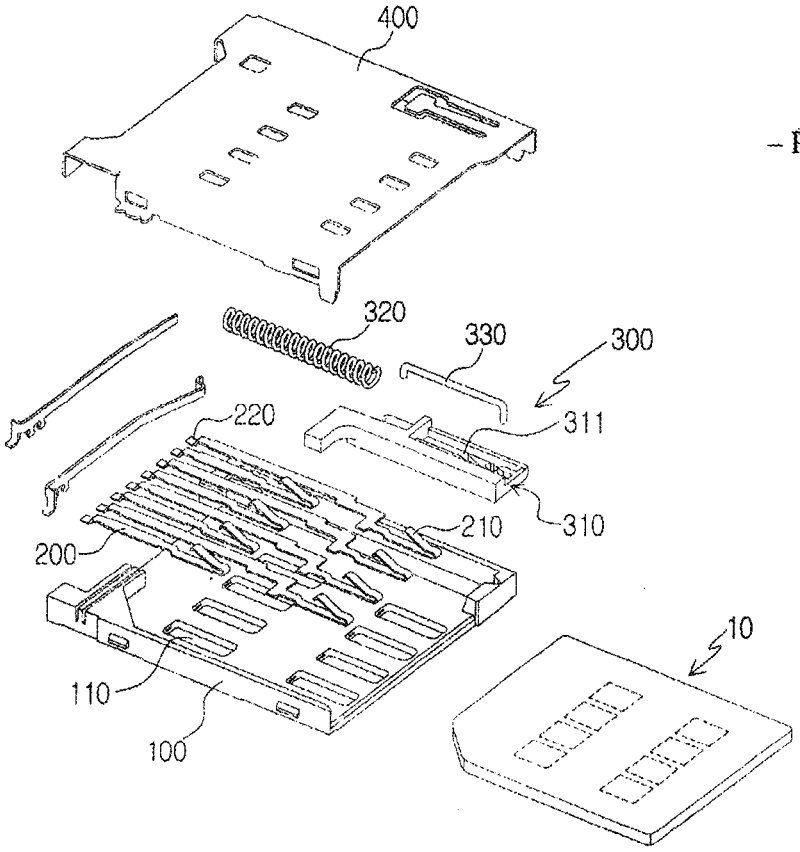
FIG. 2 is an exploded perspective view illustrating an example of a socket for a nano SIM card according to the prior art.

10: SIM card
11-18: first to eighth connection parts
100: housing
110: through-openings for contact parts
120: through-openings for soldering parts
200: terminals
210: contact parts
220: soldering parts

BEST MODE FOR CARRYING OUT THE INVENTION

Reference will be now made in detail to preferred embodiments of the present invention with reference to the attached drawings.

Figure 3:
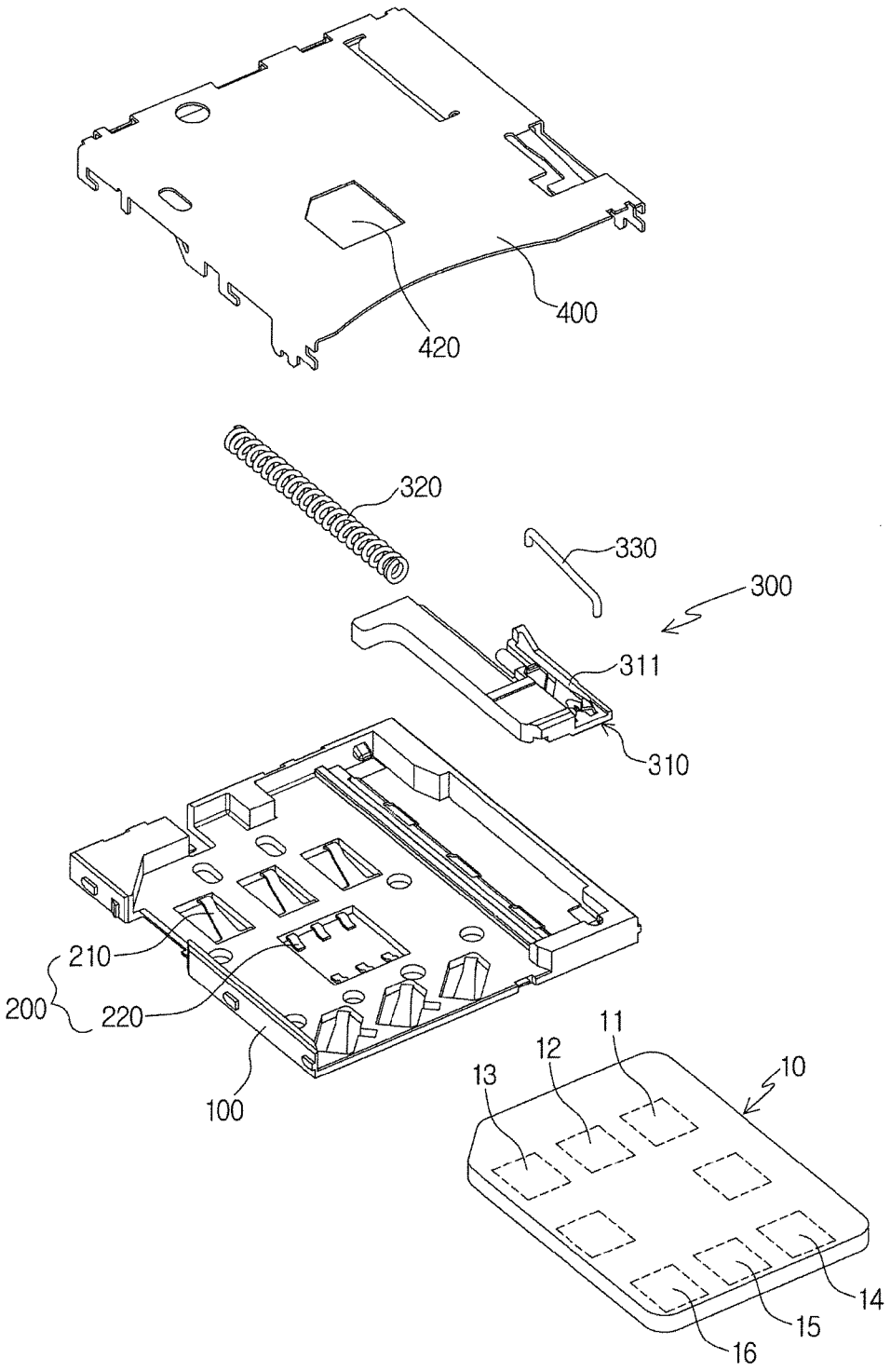
FIG. 3 is an exploded perspective view illustrating a socket for a nanoSIM card according to an embodiment of the present invention.

FIG. 3 is an exploded perspective view illustrating a socket for a nanoSIM card according to an embodiment of the present invention.

The socket according to this embodiment has the same structure as that of a socket disclosed in Korean Patent Registration No. 1201667 in that it includes: a housing 100 made of a synthetic resin material, a plurality of terminals 200 each having a contact part 210 mounted on the housing 100 and brought into close contact with an associated one of connection parts of an SIM card 10 and a soldering part 220 configured to be soldered to a printed circuit board; a cam slider 300 including a slider 310 having a heart cam 311, a spring 320, and an operating rod 330, and configured to insert and withdraw the SIM card 10 into and from the socket; and a cover 400 made of a metal material and coupled to the top of the housing 100 to define a space between the housing 100 and the cover 400 so that the SIM card is inserted into the space.

Figure 4:
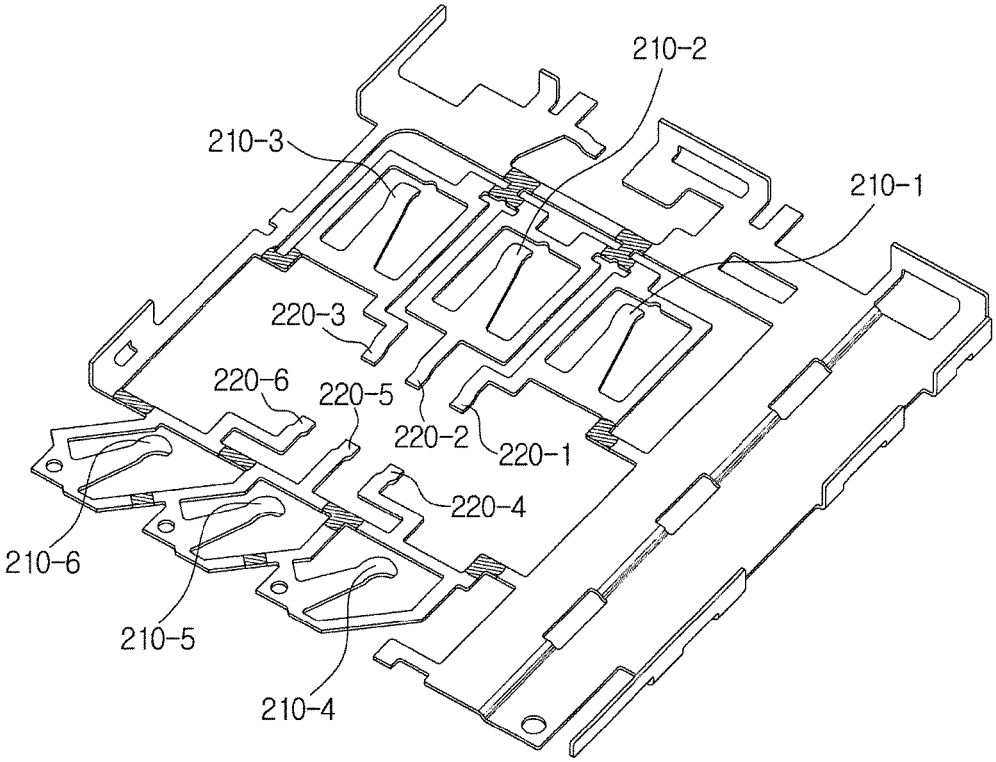
FIG. 4 is a perspective view illustrating a metal plate machined to form the terminals of a socket for a nano SIM card according to an embodiment of the present invention.

The socket according to the prior art teaches that the terminals are fittingly inserted into holes formed in the housing, but the socket according to this embodiment differs from such a conventional socket in that it employs an insert injection method in which the housing made of a synthetic resin material is injection-molded together with a metal plate as shown FIG. 4 machined to form the terminals. However, this difference is irrelevant to the technical spirit of the present invention.

In this embodiment, the terminals inside the housing are separated from each other by punching the hatched portions shown in FIG. 4.

As shown in FIG. 4, each terminal includes a contact part (210-*n*, n=1 to 6) having a cantilever shape and a soldering part (220-*n*, n=1 to 6). The soldering part (220-*n*, n=1 to 6) is soldered to a printed circuit board.

In this embodiment, a nano SIM card includes first to sixth connection parts 11 to 16 formed on the underside thereof. The first to third connection parts 11 to 13 are arranged in a transverse direction, and the fourth to sixth connection parts 14 to 16 are arranged in parallel with the first to third connection parts 11 to 13 in such a manner that the first connection part 11 confronts the fourth connection part 14, the second connection part 12 confronts the fifth connection part 15, the third connection part 13 confronts the sixth connection part 16.

In this embodiment, the contact parts (210-*n*, n=1 to 6) of the terminal are brought into close contact with the first to sixth connection parts (11 to 16 of the nano SIM card.

Figure 5:
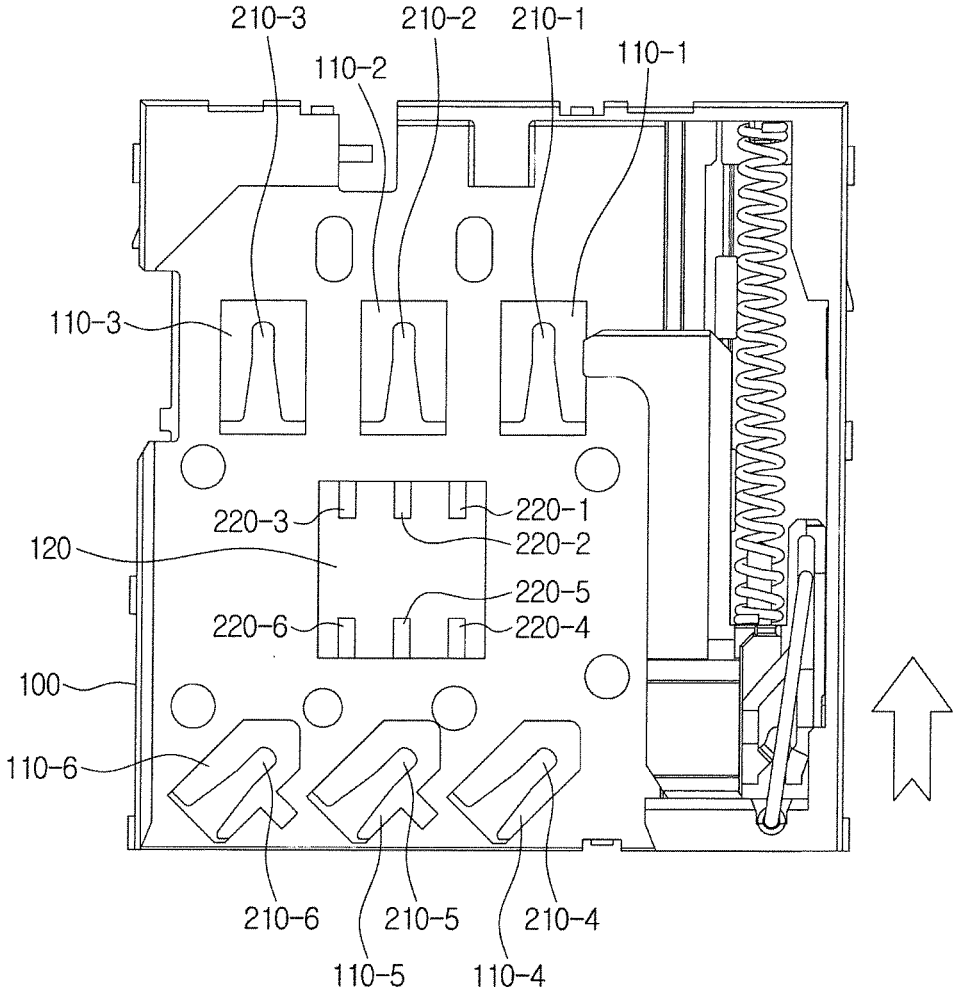
FIG. 5 is a top plan view illustrating the inner structure of a socket for a nano SIM card according to an embodiment of the present invention.

FIG. 5 is a top plan view illustrating a state in which the cover is removed from the socket of this embodiment.

The housing 100 includes through-openings (110-*n*, n=1 to 6) for first to sixth contact parts, which are formed at positions corresponding to the positions of the respective connection parts of the nano SIM card when the nano SIM card is inserted into the socket.

In addition, the housing 100 includes a through-opening 120 for soldering parts first to sixth contact parts so as to allow the soldering parts to be positioned therein. The through-opening 120 for soldering parts is disposed between the through-openings (110-*n*, n=1 to 3) for first to third contact parts and the through-openings (110-*n*, n=4 to 6) for fourth to sixth contact parts.

The contact parts (210-*n*, n=1 to 6) of the first to sixth terminals are exposed to the outside through the through-openings (110-*n*, n=1 to 6) for first to sixth contact parts, and the soldering parts (220-*n*, n=1 to 6) of the first to sixth terminals are exposed to the outside along the opposed inner peripheral surfaces of the through-opening 120 for soldering parts, which run in parallel with the transverse direction of the through-openings (110-*n*, n=1 to 6) for first to sixth contact parts.

As such, since the soldering parts (220-*n*, n=1 to 6) of first to sixth terminals are arranged to respectively correspond to the connection parts 11 to 16 of the nano SIM card, the arrangement structure of the soldering parts can be easily identified. In addition, since the through-opening 120 for soldering parts is positioned between the through-openings (110-*n*, n=1 to 3) for first to third contact parts and the through-openings (110-*n*, n=4 to 6) for fourth to sixth contact parts, the introduction of foreign substances between the soldering parts from the outside can be suppressed, thereby preventing electrical connection failures from occurring due to the introduction of foreign substances.

Preferably, the cover 400 further includes a through-opening 420 for observation so as to allow the soldering parts (220-*n*, n=1 to 6) exposed to the outside through the through-opening 120 for soldering parts to be observed therethrough. Thus, the socket according to this embodiment is soldered to the printed circuit board and then a test of the terminals can be carried out through the through-opening 420 for observation.

The through-opening for observation may be formed at positions corresponding to the contact parts (210-*n*, n=1 to 6) to perform a test of the terminals, but there is a high possibility that foreign substances will enter the socket through the through-opening for observation. For this reason, the through-opening for observation is preferably formed at a position corresponding to the through-opening for soldering parts. The through-opening for observation may preferably have a shape of the nano SIM card that can indicate a direction in which the nano SIM card is correctly inserted into the housing.

In this embodiment, the contact parts (210-*n*, n=4 to 6) having a cantilever shape of the fourth to sixth terminals are arranged obliquely relative to a direction (an arrow direction in FIG. 5) in which the nano SIM card is inserted into the socket. Thus, since the depth of the nano SIM card inserted into the socket can be reduced, the nano SIM card can be smoothly inserted and withdrawn into and from the socket of a push-push pattern. In addition, since the cantilever length of the contact part of each terminal can be set substantially constantly, the contact parts of the terminals can be brought into close contact with the connection parts of the nano SIM card with a proper strength.

It is of course to be noted that only the contact parts (210-*n*, n=4 to 6) of the fourth to sixth terminals are arranged obliquely in this embodiment, but the contact parts (210-*n*, n=1 to 3) of the first to third terminals may be arranged obliquely according to the need.

Figure 6:
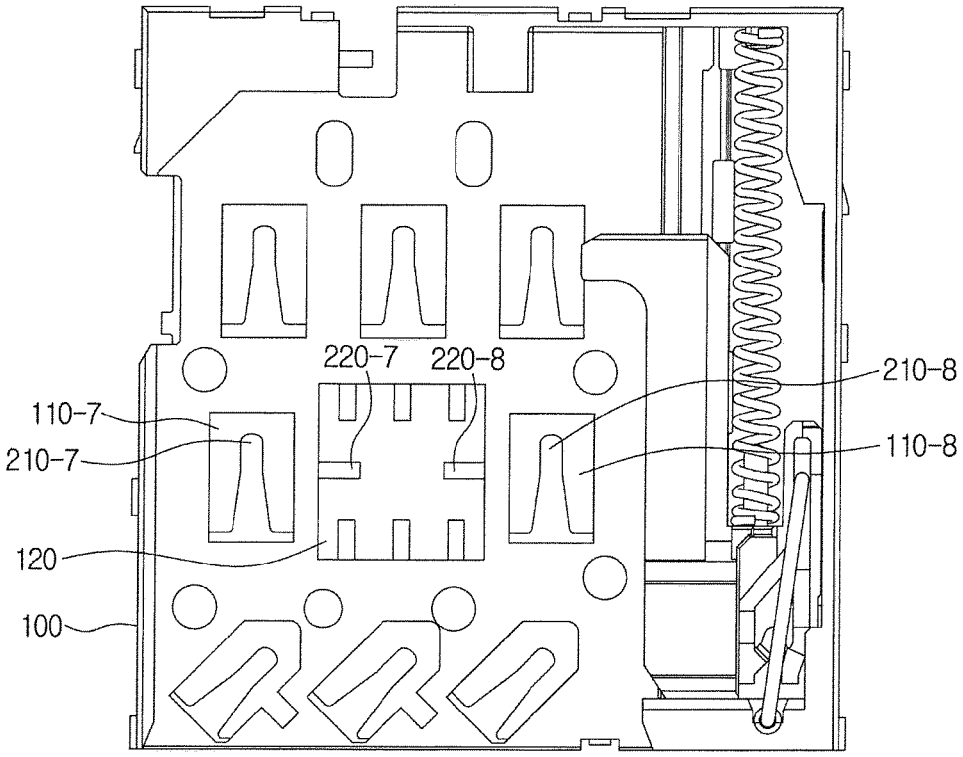
FIG. 6 is a top plan view illustrating the inner structure of a socket for a nano SIM card according to another embodiment of the present invention.

FIG. 6 is a top plan view illustrating the inner structure of a socket for a nano SIM card according to another embodiment of the present invention.

In FIG. 6, the socket according to another embodiment of the present invention will be applied to the case where the nano SIM card further includes a seventh connection part disposed between the first connection part 11 and the fourth connection part 14, and an eighth connection part 18 disposed between the third connection part 13 and the sixth connection part 16 as shown in FIG. 1 (*c*).

In this embodiment, the socket further includes seventh and eighth terminals brought into close contact with the seventh and eighth connection parts 17 and 18 of the nano SIM card, and the housing further includes through-openings (110-*n*, n=7, 8) for seventh and eighth contact parts so as to allow the contact parts (210-*n*, n=7, 8) of the seventh and eighth terminals to be exposed to the outside therethrough, and the soldering parts (220-*n*, n=7, 8) of the seventh and eighth terminals are exposed to the outside along the opposed inner peripheral surfaces of the through-opening 120 for soldering parts, which runs in parallel with the longitudinal direction of the through-openings (110-*n*, n=7, 8) for seventh and eighth contact parts.

The above-mentioned two embodiments employ a cam slider configured to insert and withdraw the nano SIM card into and from the socket in a push-push pattern, but the present invention can also be applied to the case where an SIM card tray that supports the SIM card is applied as used in an iPhone 4/4s.

While the present invention has been described in connection with the exemplary embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should be defined by the technical spirit of the appended claims.

The invention claimed is:

1. A socket for a nano SIM card comprising first to third connection parts arranged in a transverse direction, and fourth to sixth connection parts arranged in parallel with the first to third connection parts in such a manner that the first connection part confronts the fourth connection part, the second connection part confronts the fifth connection part, the third connection part confronts the sixth connection part, the socket comprising:

first to sixth terminals each comprising a contact part configured to be brought into close contact with an associated one of the connection parts of the nano SIM card and a soldering part configured to be soldered to a print circuit board;

a housing comprising through-openings for first to sixth contact parts, which are formed at positions corresponding to the positions of the respective connection parts of the nano SIM card when the nano SIM card is inserted into the socket; and a cover coupled to the housing to define a space between the housing and the cover so that the SIM card is inserted into the space, wherein the housing comprises a through-opening for soldering parts, which is disposed between the through-openings for first to third contact parts, which are arranged in parallel with each other, and the through-openings for fourth to sixth contact parts, which are arranged in parallel with each other, wherein the contact parts of the first to sixth terminals are exposed to the outside through the through-openings for first to sixth contact parts, and wherein the soldering parts of the first to sixth terminals are exposed to the outside along the opposed inner peripheral surfaces of the through-opening for soldering parts, which run in parallel with the transverse direction of the through-openings for first to sixth contact parts, wherein the nano SIM card further comprises a seventh connection part disposed between the first connection part and the fourth connection part, and an eighth connection part disposed between the third connection part and the sixth connection part, wherein the socket further comprises seventh and eighth terminals configured to be brought into close contact with the seventh and eighth connection parts of the nano SIM card, wherein the housing further comprises through-openings for seventh and eighth contact parts so as to allow the contact parts of the seventh and eighth terminals to be exposed to the outside therethrough, and wherein the soldering parts of the seventh and eighth terminals are exposed to the outside along the opposed inner peripheral surfaces of the through-opening for soldering parts, which run in parallel with the longitudinal direction of the through-openings for seventh and eighth contact parts.

2. The socket for a nano SIM card according to claim 1, wherein the contact part having a cantilever shape of at least one of the first to sixth terminals is arranged obliquely relative to a direction in which the nano SIM card is inserted into the socket.

3. The socket for a nano SIM card according to claim 1, wherein the cover further comprises a through-opening for observation so as to allow the through-opening for soldering parts to be observed therethrough.

4. A socket for a nano SIM card comprising first to third connection parts arranged in a transverse direction, and fourth to sixth connection parts arranged in parallel with the first to third connection parts in such a manner that the first connection part confronts the fourth connection part, the second connection part confronts the fifth connection part, the third connection part confronts the sixth connection part, the socket comprising:

first to sixth terminals each comprising a contact part configured to be brought into close contact with an associated one of the connection parts of the nano SIM card and a soldering part configured to be soldered to a print circuit board;

a housing comprising through-openings for first to sixth contact parts, which are formed at positions corresponding to the positions of the respective connection parts of the nano SIM card when the nano SIM card is inserted into the socket; and a cover coupled to the housing to define a space between the housing and the cover so that the SIM card is inserted into the space, wherein the housing comprises a through-opening for soldering parts, which is disposed between the through-openings for first to third contact parts, which are arranged in parallel with each other, and the through-openings for fourth to sixth contact parts, which are arranged in parallel with each other, wherein the contact parts of the first to sixth terminals are exposed to the outside through the through-openings for first to sixth contact parts, and wherein the soldering parts of the first to sixth terminals are exposed to the outside along the opposed inner peripheral surfaces of the through-opening for soldering parts, which run in parallel with the transverse direction of the through-openings for first to sixth contact parts, wherein the contact part having a cantilever shape of at least one of the first to sixth terminals is arranged obliquely relative to a direction in which the nano SIM card is inserted into the socket.

* * * * *